United States Patent [19]

Kaminaka

[11] 4,236,055

[45] Nov. 25, 1980

[54] MICROWAVE OVEN INCLUDING A DIGITAL CONTROL SYSTEM AND A HEATER DISPOSED IN AN OVEN CAVITY

[75] Inventor: Ikuyasu Kaminaka, Osaka, Japan

[73] Assignee: Sharp Kabushiki Kaisha, Osaka, Japan

[21] Appl. No.: 958,656

[22] Filed: Nov. 8, 1978

[30] Foreign Application Priority Data

Nov. 10, 1977 [JP] Japan ..... 52-135442

[51] Int. Cl.[3] ..... H05B 6/68

[52] U.S. Cl. ..... 219/10.55 B; 219/10.55 R; 361/384

[58] Field of Search ..... 219/10.55 B, 10.55 E, 219/10.55 R, 10.55 C, 10.55 F, 400, 364; 361/384, 385

[56] References Cited

U.S. PATENT DOCUMENTS

| | | | |
|---|---|---|---|
| 2,471,784 | 5/1949 | Seifner et al. | 219/364 |
| 2,831,952 | 4/1958 | Warner | 219/10.55 B |
| 2,860,026 | 11/1958 | Long | 219/10.55 B |
| 3,081,392 | 3/1963 | Warner | 219/10.55 B |
| 3,407,279 | 10/1968 | Greenberg | 219/10.55 B |
| 3,440,386 | 4/1969 | Boehm | 219/10.55 B |
| 3,523,170 | 8/1970 | Boehm | 219/10.55 B |
| 3,569,656 | 3/1971 | White | 219/10.55 B |
| 3,936,659 | 2/1976 | Mainord | 219/400 |
| 3,967,874 | 7/1976 | Calabro | 361/384 X |
| 4,039,776 | 8/1977 | Roderick | 219/400 X |
| 4,107,501 | 8/1978 | Ironfield | 219/10.55 F X |

OTHER PUBLICATIONS

Texas Instrument Inc. Publication, 1976, Microwave Oven Controller Manual, Cover Sheet.

IBM Technical Disclosure Bulletin, vol. 20, No. 6, Nov. 1977, "Cooling Electrical Equipment", Gaunt et al.

*Primary Examiner*—B. A. Reynolds

*Assistant Examiner*—Philip H. Leung

*Attorney, Agent, or Firm*—Birch, Stewart, Kolasch & Birch

[57] ABSTRACT

A microwave oven comprises a magnetron for microwave cooking purposes, a heater disposed in an oven cavity for electric heating cooking purposes, and a digital control system including a semiconductor microprocessor for controlling operation of the magnetron and the heater in accordance with a desired program. A cooling fan is driven to rotate to cool the semiconductor microprocessor during the electric heating cooking operation and for a predetermined period of time subsequent to the completion of the electric heating cooking operation.

2 Claims, 3 Drawing Figures

MICROWAVE OVEN INCLUDING A DIGITAL CONTROL SYSTEM AND A HEATER DISPOSED IN AN OVEN CAVITY

BACKGROUND AND SUMMARY OF THE INVENTION

The present invention relates to a microwave oven including a digital control system and a heater means for performing electric cooking or browning operation.

The present invention relates, more specifically, to a cooling fan system of a microwave oven including a digital control system and a heater means disposed in the oven cavity.

Recently, a digitalized microwave oven has been developed, which includes a digital control system comprising a semiconductor microprocessor for controlling microwave generation, and a keyboard panel for introducing desired program commands into the semiconductor microprocessor. A typical microwave oven of the above feature is commercially available as "Microwave Oven R-9000" manufactured by SHARP KABUSHIKI KAISHA. A typical control system is disclosed in U.S. Pat. No. 4,011,428 entitled "MICROWAVE OVEN TIMER AND CONTROL CIRCUIT" issued on Mar. 8, 1977. Another typical control circuit is described in copending application, "MICROWAVE OVEN WITH A PROGRAMMABLE DIGITAL CONTROL CIRCUIT," Ser. No. 792,222, filed on Apr. 29, 1977 by Tsuneo Kawabata, Minoru Makita, and Sigeaki Masuzawa, and assigned to the same assignee as the present application.

On the other hand, a microwave oven including a heater means for performing electric cooking or browning operation has been developed. A typical microwave oven including a browner unit is disclosed in U.S. Pat. No. 3,878,350 entitled "MICROWAVE COOKING APPARATUS" issued on Apr. 15, 1975. An example of a combination microwave oven and an electric heating oven including a heater means for performing electric heating cooking is described in copending application, "MICROWAVE OVEN WITH A CAPABILITY OF FUNCTIONING AS AN ELECTRIC HEATING OVEN," Ser. No. 776,358, filed on Mar. 10, 1977 by Yutaka Takagi and Munemitsu Toyoda, and assigned to the same assignee as the present application.

Accordingly, when the digital control system is adapted to a microwave oven including a heater means, programmed cooking inclusive of the microwave cooking and electric heating cooking can be conducted. However, attention should be directed to the fact that the exterior of the oven cavity is also heated up in the electric heating cooking operation. The semiconductor microprocessor included in the digital control system must be protected from a high temperature.

Accordingly, an object of the present invention is to provide a microwave oven including a digital control system and a heater means.

Another object of the present invention is to project a digital control circuit from a high temperature in a combination microwave oven and electric oven.

Still another object of the present invention is to provide a novel cooling system for a combination microwave oven and electric oven.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a combination microwave oven and electric oven is provided with a digital control circuit comprising a semiconductor microprocessor. The semiconductor microprocessor controls the programmed microwave cooking and electric cooking. The semiconductor microprocessor is mounted on a circuit board which is secured to a rear surface of a control panel including a plurality of instruction keys for introducing desired program commands into the semiconductor microprocessor.

A cooling fan system is provided for cooling a microwave generation means and the semiconductor microprocessor during the microwave cooking operation and the electric heating operation. A control system functions to activate the cooling fan system for a predetermined period of time after completion of the electric heating operation, thereby preventing occurrence of a high temperature around the semiconductor microprocessor.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
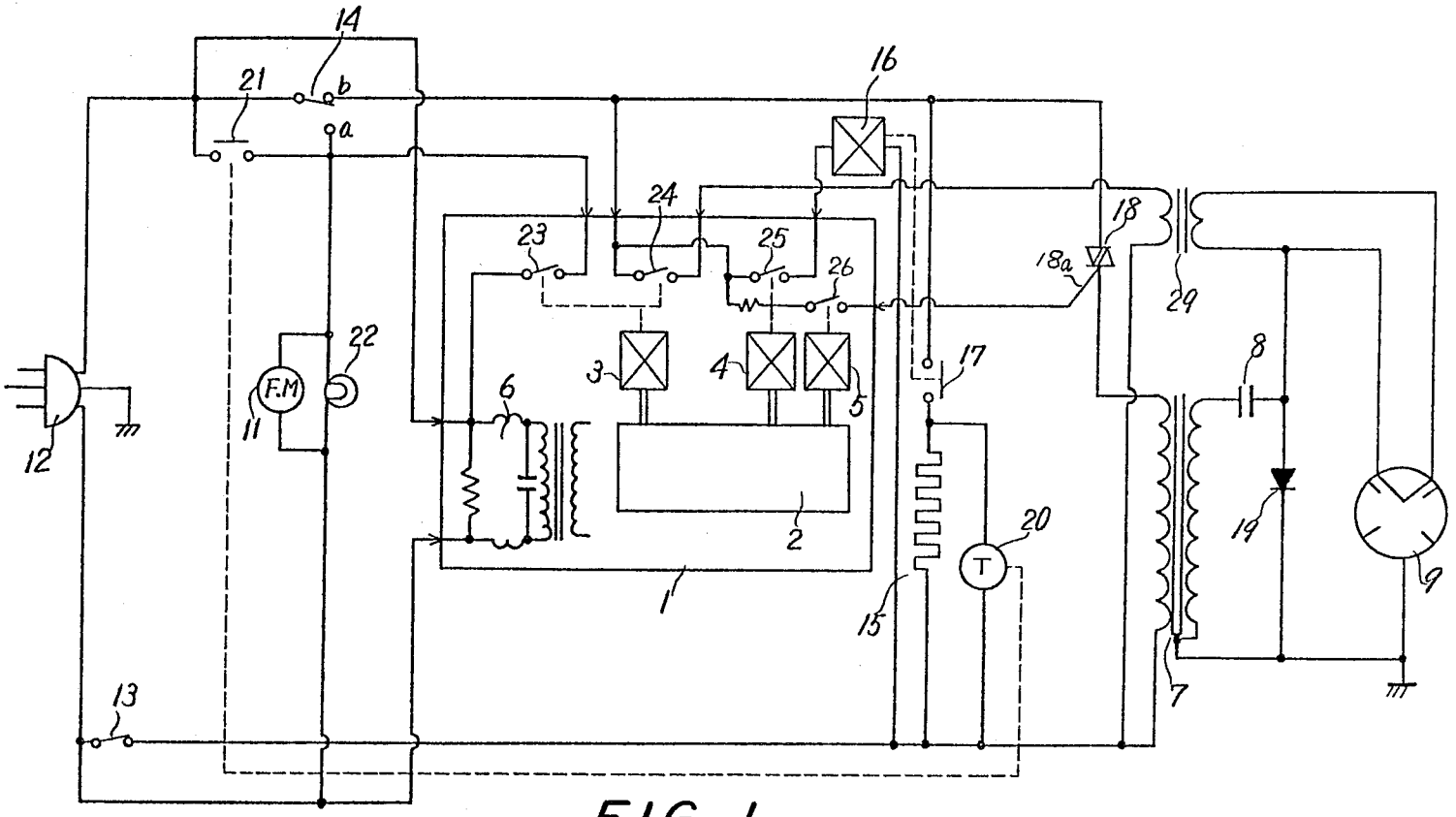
FIG. 1 is a schematic circuit diagram of an embodiment of a microwave oven of the present invention.
Figure 2:
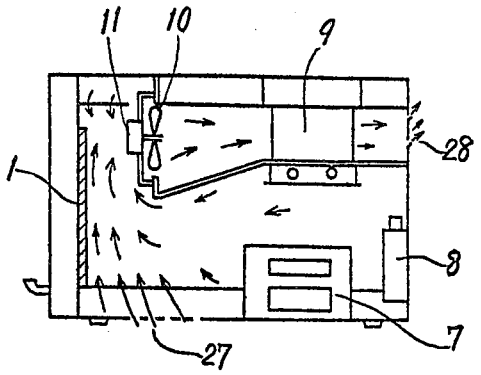
FIG. 2 is a side view of the microwave oven of FIG. 1, wherein a side wall is removed for facilitating an understanding of the present invention.

FIGS. 1 and 2 show an embodiment of a microwave oven of the present invention.

A control system of the microwave oven mainly comprises a microprocessor 2 mounted on a circuit board 1. The microprocessor 2 is made of a large scale integrated semiconductor device for controlling microwave generation and heater energization in accordance with a program stored therein. A magnetron control relay 3, a heater control relay 4, and a microwave output level control relay 5 are also mounted on the circuit board 1, and connected to receive control signals derived from the microprocessor 2. These elements are power supplied by a power supply circuit 6 mounted on the circuit board 1.

The circuit board 1 is secured to a rear wall of a control panel which includes a plurality of keys for introducing desired commands or information for program purposes. More specifically, the circuit board 1 is disposed in a clearance formed between the microwave oven housing and an oven cavity wall.

A high voltage transformer 7, a capacitor 8, a magnetron 9, a cooling fan 10, and a fan motor 11 for driving the cooling fan 10 are also disposed in the clearance formed between the housing and the cavity wall. The cooling fan 10 functions to cool the microprocessor 2 mounted on the circuit board 1 and the magnetron 9 during the microwave cooking operation and the electric heating cooking operation.

A plug 12 is provided for receiving commercial power supply and functions to continuously supply electric power to the power supply circuit 6 mounted on the circuit board 1. The circuit of FIG. 1 further comprises a first door switch 13 and a second door switch 14 is associated with open/close operation of an oven door. The first door switch 13 is switched on when the oven door is closed. The second door switch 14 is connected to one terminal a when the oven door is in the open state, and connected to another terminal b when the oven door is in the closed condition.

A heater 15 is disposed in the oven cavity for performing the electric heating cooking through the use of infrared ray radiation. The heater 15 is energized through a relay contact 17 associated with a second heater control relay 16, which is associated with the heater control relay 4. The primary winding of the high voltage transformer 7 is connected to a triac 18, of which the gate electrode 18*a* is connected to receive a control signal for controlling power supply to the primary winding of the high voltage transformer 7. The secondary winding of the high voltage transformer 7 is connected to a resonance circuit comprising the capacitor 8 and a diode 19, thereby supplying a high voltage to an anode electrode of the magnetron 9 in order to develop microwave energy toward the oven cavity.

Figure 3:
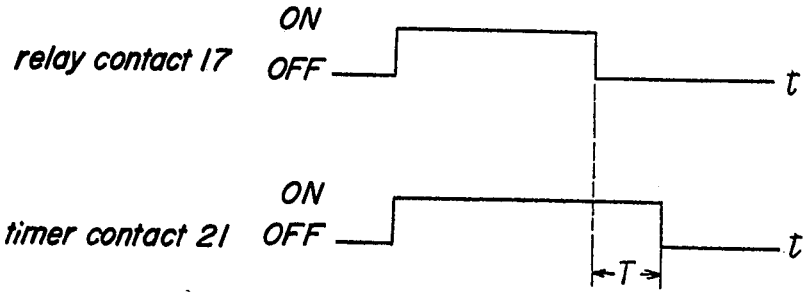
FIG. 3 is a time chart for explaining operation of the microwave oven of FIG. 1.

A timer 20 is connected to the heater 15 in a parallel fashion. The timer 20 shows the off-delay characteristics, and is preferably made of "ATS timer" manufactured by Omron Tateishi Electronics Corporation. More specifically, a timer contact 21 associated with the timer 20 is switched on in response to the turning on of the relay contact 17, whereas the timer contact 21 is held in the on condition for a predetermined period of time T after turning off of the relay contact 17 as shown in FIG. 3.

Operation of the microwave oven of FIGS. 1 and 2 is as follows:

Desired cooking sequence is programmed in the microprocessor 2 through the use of the numerals keys and the function keys formed on the control panel. A typical program system is disclosed in U.S. Pat. No. 4,011,428 entitled "MICROWAVE OVEN TIMER AND CONTROL CIRCUIT" issued on Mar. 8, 1977. Another typical program system is described in copending application, "MICROWAVE OVEN WITH A PROGRAMMABLE DIGITAL CONTROL CIRCUIT," Ser. No. 792,222 filed on Apr. 29, 1977 by Tsueno Kawabata, Minoru Makita, and Sigeaki Masuzawa, and assigned to the same assignee as the present application.

The following is an example of the microwave/-browning sequence, wherein the browning operation is conducted by the heater 15 after completion of the microwave cooking conducted by the magnetron 9.

When the oven door is opened to place the foodstuff in the oven cavity, an oven lamp 22 is enabled through the terminal a of the second door switch 14 to illuminate the oven cavity. When the oven door is closed and a cooking button is actuated, the microprocessor 2 develops a cooking initiation command in accordance with the program stored therein. The magnetron control relay 3 is enabled to switch on relay contacts 23 and 24. Under these conditions, the oven lamp 22 and the fan motor 11 are enabled through the relay contact 23. The cooling fan 10 functions to introduce a fresh air from openings 27 formed in the bottom wall of the oven housing as shown in FIG. 2. The thus introduced fresh air cools the high voltage transformer 7, the circuit board 1 inclusive of the microprocessor 2, and the magnetron 9 and, then, exhausted through openings 28 formed on the rear wall of the oven housing.

A heater transformer 29 connected to the magnetron 9 is energized through the relay contact 24. Accordingly, the magnetron 9 develops the microwave energy when the triac 18 is in the on state. The on/off operation of the triac 18 is controlled by the microwave output level control relay 5, which is controlled by an output signal of the microprocessor 2. More specifically, when the microwave energy is desired to be developed continuously, the microwave output level control relay 5 is continuously energized to continuously switch on a relay contact 26. When, for example, 60% output cooking is desired to be performed, the control signal derived from the microprocessor 2 functions to intermittently enable the microwave output level control relay 5 at a rate of 60%.

After completion of the microwave cooking, the program is advanced to the electric heating cooking. The magnetron control relay 3 and the output level control relay 5 are disabled, and the heater control relay 4 is enabled. The second heater control relay 16 is energized when a relay contact 25 is switched on, thereby switching on the relay contact 17. Under these conditions, the heater 15 and the timer 20 are power supplied. The timer 20 functions to close the timer contact 21, whereby the fan motor 11 and the oven lamp 22 are power supplied. Therefore, the cooling fan 10 functions to cool the high voltage transformer 7, the circuit board 1 and the magnetron 9 in order to protect the elements from the high temperature.

When the programmed electric heating cooking is completed, the heater control relay 4 is disabled and, therefore, the power supply to the heater 15 and the timer 20 is terminated. However, since the timer 20 has the off-delay characteristics, the timer contact 21 is held in the on condition for the period of time T after the power supply to the timer 20 is terminated. Accordingly, the cooling fan 10 continues the rotation to cool the high voltage transformer 7, the microprocessor 2 and the magnetron 9, thereby protecting them from the high temperature created by the electric heating cooking. It should be noted that, in the electric heating cooking, the oven cavity wall is heated up. If the cooling fan 10 is disabled immediately after termination of the power supply to the heater 15, the elements, especially the microprocessor 2, will be damaged by the high temperature.

An example of the microprocessor 2 for conducting the programmed cooking is commercially available as "LI-2061" or "LI-2035" manufactured by SHARP KABUSHIKI KAISHA. The "LI-2061" and "LI-2035" include a digital timer system functioning as the timer 20 of the above-discussed embodiment. A preferred delay time of the timer 20 is about 30 seconds.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A microwave oven energized by a power source, having an oven door, and capable of providing microwave cooking and electric heating cooking, comprising:

means for introducing a supply of energy from said power source to said microwave oven; and circuit means energized by said supply of energy from said power source for controlling the operation of said microwave oven, said circuit means further comprising, microprocessor means energized by said supply of energy for developing control instructions to control said microwave oven, magnetron control relay means controlled by said microprocessor means, first heater control relay means controlled by said microprocessor means, microwave output control relay means controlled by said microprocessor means, first switch means controlled by said magnetron control relay means, second switch means controlled by said magnetron control relay means, third switch means controlled by said first heater control relay means, and fourth switch means controlled by said microwave output control relay means;

fan means energized by said supply of energy via said first switch means for cooling said circuit board means when said first switch means is in a first switched position;

magnetron means energized by said supply of energy via said second switch means and said fourth switch means for developing microwave energy when said second switch means and said fourth switch means are in a first switched position thereby providing said microwave cooking for said microwave oven;

wherein said first, second, and fourth switch means switch to a second switched position in response to said control instructions from said microprocessor means via said magnetron control relay means and said microwave output control relay means when said microwave cooking is completed, said third switch means switching to a first switched position in response to said control instructions from said microprocessor means via said first heater control relay means when said microwave cooking is completed;

second heater control relay means connected to said third switch means for controlling said electric heating cooking;

fifth switch means controlled by said second heater control relay means;

heater means energized by said supply of energy from said power source and controlled by said second heater control relay means via said fifth switch means for developing said electric heating cooking;

wherein said second heater control relay means switches said fifth switch means to a first switched position when said third switch means is switched to said first switched position; and wherein said heater means develops said electric heating cooking when said fifth switch means switches to said first switched position;

timer means energized by said supply of energy from said power source, and controlled by said second heater control relay means via said fifth switch means for controlling the operation of said fan means for a period of time subsequent to the termination of said electric heating cooking;

wherein said heater control relay means switches said third switch means to a second switched position in response to said control instructions from said microprocessor means, said second heater control relay means switching said fifth switch means to a second switched position in response to the switching of said third switch means to said second switched position, said heater means terminating the development of said electric heating cooking when said fifth switch means switches to said second switched position; and wherein said timer means continues to control the operation of said fan means for said period of time subsequent to the switching of said fifth switch means to said second switched position.

2. A microwave oven energized by a power source, having an oven door, and capable of providing microwave cooking and electric heating cooking, comprising:

means for introducing a supply of energy from said power source to said microwave oven; and circuit means energized by said supply of energy from said power source for controlling the operation of said microwave oven, said circuit means further comprising, microprocessor means energized by said supply of energy for developing control instructions to control said microwave oven, magnetron control relay means controlled by said microprocessor means, first heater control relay means controlled by said microprocessor means, first switch means controlled by said magnetron control relay means, second switch means controlled by said magnetron control relay means, third switch means controlled by said first heater control relay means, and fan means energized by said supply of energy via said first switch means for cooling said circuit board means when said first switch means is in a first switched position;

magnetron means energized by said supply of energy via said second switch means for developing microwave energy when said second switch means is in a first switched position thereby providing said microwave cooking for said microwave oven;

wherein said first and second switch means switch to a second switched position in response to said control instructions from said microprocessor means via said magnetron control relay means when said microwave cooking is completed, said third switch means switching to a first switched position in response to said control instructions from said microprocessor means via said first heater control relay means when said microwave cooking is completed;

second heater control relay means connected to said third switch means for controlling said electric heating cooking;

fourth switch means controlled by said second heater control relay means;

heater means energized by said supply of energy from said power source and controlled by said second heater control relay means via said fourth switch means for developing said electric heating cooking;

wherein said second heater control relay means switches said fourth switch means to a first switched position when said third switch means is switched to said first switched position; and wherein said heater means develops said electric heating cooking when said fourth switch means switches to said first switched position;

timer means energized by said supply of energy from said power source, and controlled by said second heater control relay means via said fourth switch means for controlling the operation of said fan means for a period of time subsequent to the termination of said electric heating cooking;

wherein said heater control relay means switches said third switch means to a second switched position in response to said control instructions from said microprocessor means, said second heater control relay means switching said fourth switch means to a second switched position in response to the switching of said third switch means to said second switched position, said heater means terminating the development of said electric heating cooking when said fourth switch means switches to said second switched position; and wherein said timer means continues to control the operation of said fan means for said period of time subsequent to the switching of said fourth switch means to said second switched position.

* * * * *